US005697447A

United States Patent [19]

Børseth

[11] Patent Number: 5,697,447

[45] Date of Patent: Dec. 16, 1997

[54] FLEXIBLE RISERS WITH STABILIZING FRAME

[75] Inventor: Knut Børseth, Tårnåsen, Norway

[73] Assignee: Petroleum Geo-Services AS, Norway

[21] Appl. No.: 602,887

[22] Filed: Feb. 16, 1996

[51] Int. Cl.[6] ..... E21B 17/01

[52] U.S. Cl. ..... 166/366; 166/367; 405/224.3; 405/224.4

[58] Field of Search ..... 166/347, 355, 166/366, 367; 405/224, 224.2, 224.3, 224.4

[56] References Cited

U.S. PATENT DOCUMENTS

| | | | |
|---|---|---|---|
| 3,572,272 | 3/1971 | Dixon et al. | 405/224.4 X |
| 3,983,706 | 10/1976 | Kalinowski . | |
| 3,993,273 | 11/1976 | Dade | 405/224.2 X |
| 4,529,334 | 7/1985 | Ortloff | 166/367 X |
| 4,556,340 | 12/1985 | Morton | 405/224.2 |
| 4,704,050 | 11/1987 | Wallace | 166/367 X |
| 4,741,647 | 5/1988 | Dumazy et al. | 405/224.4 |
| 5,380,130 | 1/1995 | Kessler et al. | 166/367 X |
| 5,421,676 | 6/1995 | Wybro et al. | 405/224 X |
| 5,553,976 | 9/1996 | Korsgaard | 166/367 X |

*Primary Examiner*—George A. Suchfield
*Attorney, Agent, or Firm*—Gordon T. Arnold; William Beard

[57] ABSTRACT

A process comprising: organizing the top of the risers; organizing the bottom of the risers; and twisting the risers to impose tension in the risers. A system comprising: an organizer of the top of the risers; an organizer of the bottom of the risers; and a twister the risers to impose tension in the risers.

30 Claims, 5 Drawing Sheets

FLEXIBLE RISERS WITH STABILIZING FRAME

FIELD OF THE INVENTION

This invention relates to risers which transport minerals from wells on the sea floor to production vessels located at the sea surface.

BACKGROUND OF THE INVENTION

For deep sea mineral production, risers are used to transport minerals from the well located on the sea floor to production vessels on the surface. However, in deep sea environments, there are usually currents moving in a horizontal direction which act against the vertically oriented risers. Additionally, there may be currents that loop vertically and also act against the risers. These currents entangle the risers so as to prevent there efficient placement and use.

Conventional deep sea systems comprise full scale tension-leg platforms (TLPs) which use heavy, inflexible risers which are installed under tension. Inflexible risers, however, are costly to install and require larger TLPs to support the extra weight. Recently, relatively smaller platforms have been developed for deep sea operations where marginal production does not merit the use of a full scale tension-leg platform (TLP). These marginal platforms use tension-leg mooring and production facilities, like conventional tension-leg platforms, but comprise smaller floatation structures. For marginal production platforms, as disclosed in *Monopod TLP Improves Deepwater Economics*, PETROLEUM ENGINEER INTERNATIONAL (January 1993), incorporated herein by reference, the production facilities control and process incoming wellstreams in conventional fashion. However, each wellstream flows through an individual flexible riser to a conventional production manifold located aboard the marginal TLP. While these flexible risers are substantially lighter, so that they do not require a large TLP for support, they are particularly susceptible to entanglement in the ocean currents.

Therefore, there is a need for a light weight riser system which does not become entangled in ocean currents.

SUMMARY OF THE INVENTION

An object of the present invention is to address the weight and entanglement problems of prior systems by a flexible risers system that incorporates organizers at the top and bottom of the risers to separate, organize and place tension on the risers so that they do not become entangled.

According to one aspect of the invention, there is a process comprising: organizing the top of the risers; organizing the bottom of the risers; and twisting the risers to impose tension in the risers.

According to another aspect of the invention, there is provided a system comprising: an organizer of the top of the risers; an organizer of the bottom of the risers; and a twister of the risers to impose tension in the risers.

BRIEF DESCRIPTION OF THE DRAWING

The present invention is better understood by reading the following description of nonlimitative embodiments with reference to the attached drawings, wherein like parts in each of the several figures are identified by the same reference character, which are briefly described as follows.

It is to be noted, however, that the appended drawings illustrate only typical embodiments of the invention and are therefore not to be considered a limitation of the scope of the invention which includes other equally effective embodiments.

DETAILED DESCRIPTION OF THE INVENTION

Figure 1:
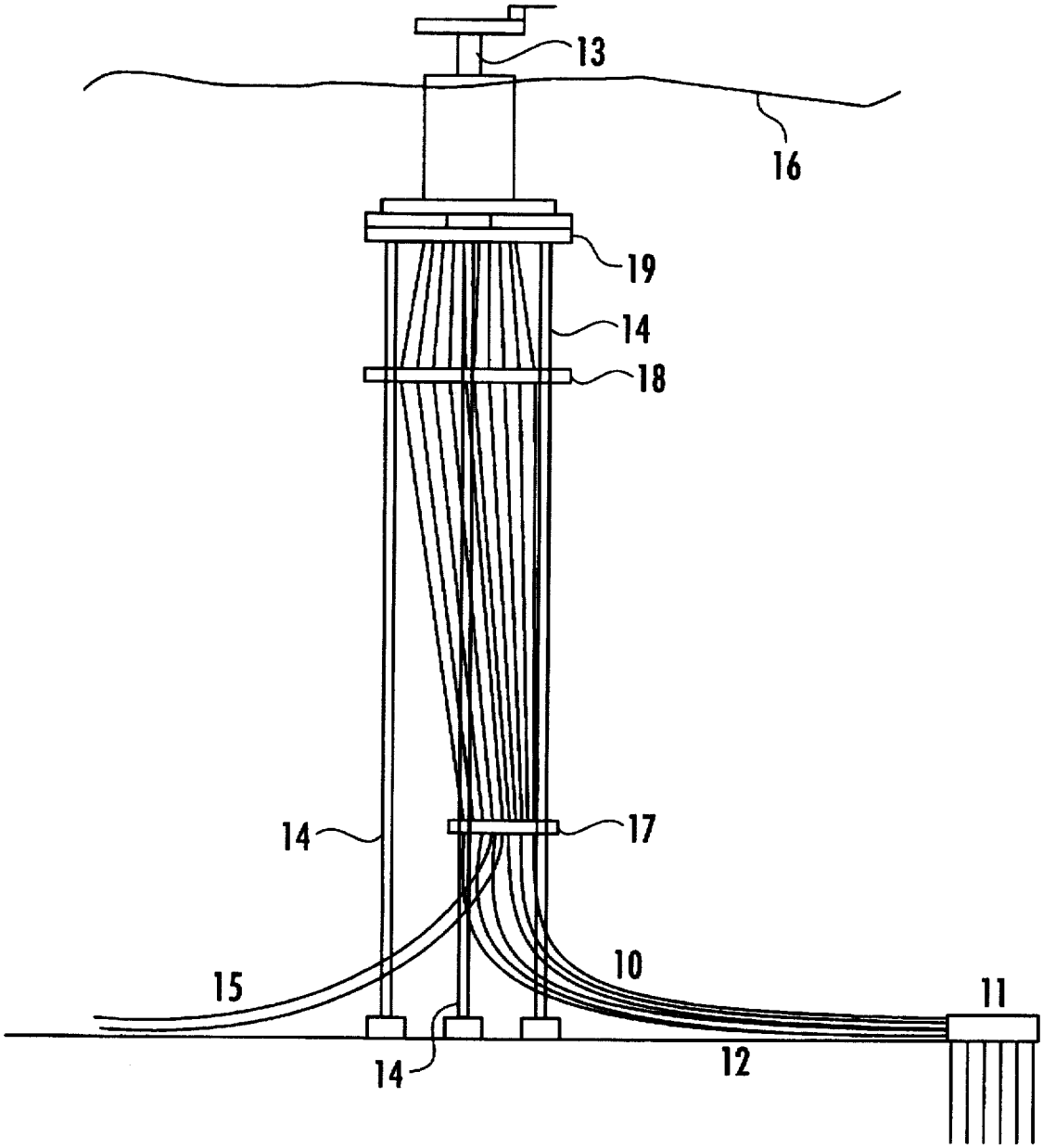
FIG. 1 is a plan view of one embodiment of an entire riser assembly with organizers at the top and bottom.

Referring to FIG. 1, a plan view of an embodiment of the present invention is shown. Risers 10 are attached at one end to wells 11 located on the sea floor 12. The risers are brought to a central location for transportation of minerals to a single production vessel 13. In this embodiment, the production vessel 13 is a tension-leg platform (TLP) having tendons 14 which anchor the TLP to the sea floor 12. In addition to the risers 10, export risers 15 are also shown. The risers 10 and export risers 15 are catenary flexible risers, rather than rigid risers used in other applications.

From the sea floor 12 to the production vessel 13, the risers 10 pass through organizers 17 and 18 and finally through a moon disc 19 just before they enter the production vessel 13. The moon disc 19 is typically placed just below the production vessel 13 to arrange the risers in a configuration necessary for connection to a production manifold located on the production platform of the production vessel 13. Organizers 17 and 18 are used to keep the risers 10 and export risers 15 straight and to induce tension in the risers 10 and export risers 15.

Figure 2:
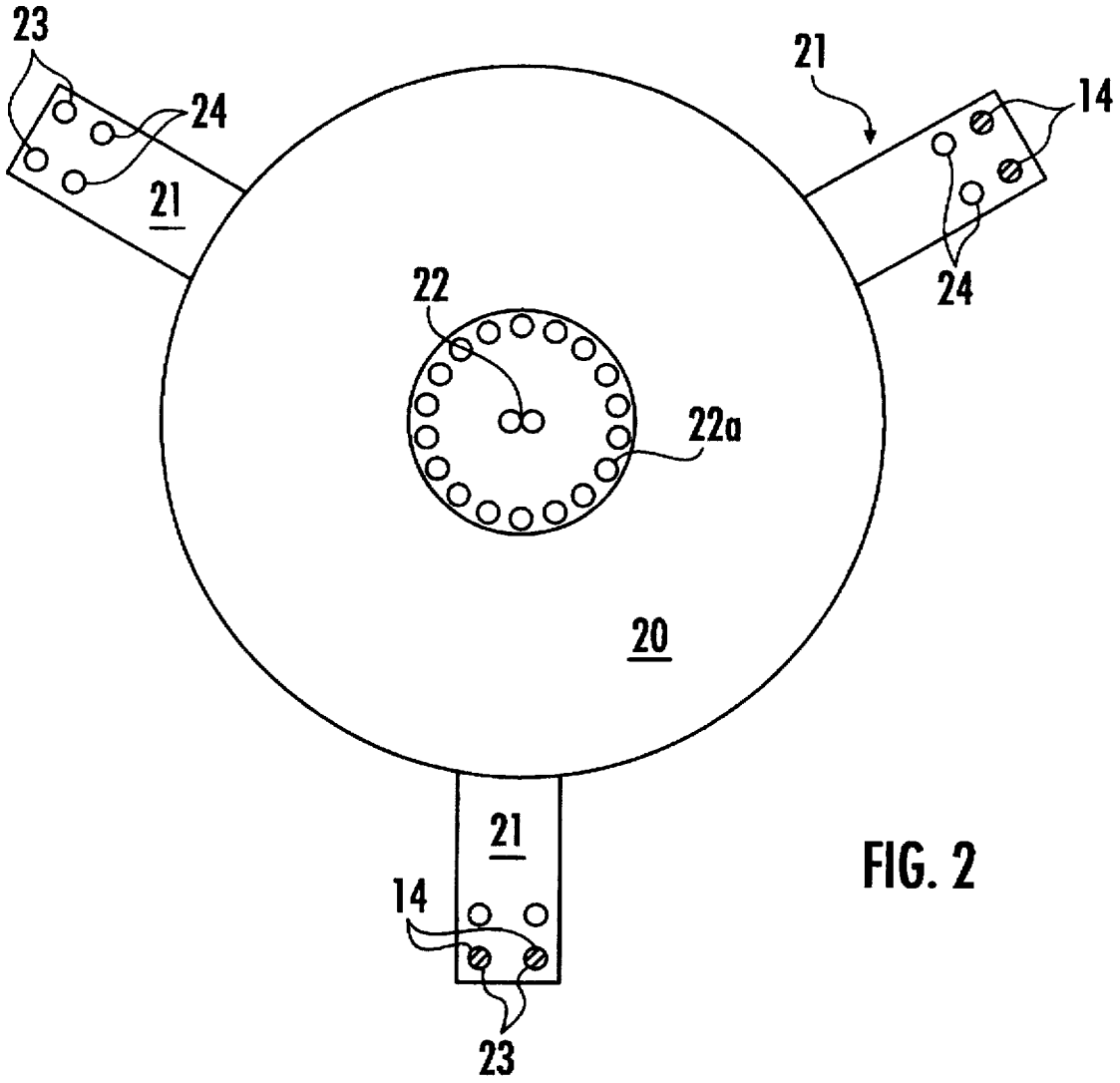
FIG. 2 is a top view of a moon disc.

Referring to FIG. 2, an embodiment of the moon disc 19 is shown. In this embodiment, the moon disc 19 comprises a center structure 20 and three support structures 21 which extend radially outward from the center structure. The risers 10 (not shown) extend through holes **22*a* while the export risers 15 (not shown) extend through holes 22*b*. The holes 22*a* and 22*b* are bellmouths which are coated on the interior with a low friction mating so that the risers 10 and export risers 15 may slide through as the height of the moon disc 19 is adjusted. The three support structures 21 attach to the tendons 14 of the TLP. The tendons extend through holes 23 at the ends of each of the support structures 21. Suspension wires 24 are also attached to the support structure 21, just inside tendon holes 23. The suspension wires 24 suspend the moon disc 19 at a desired distance below the TLP. The suspension wires 24 are attached to the TLP according to any means known. Further, the depth of the moon disc 19 is controlled by lengthening or letting out the suspension wires 24**.

Figure 3:
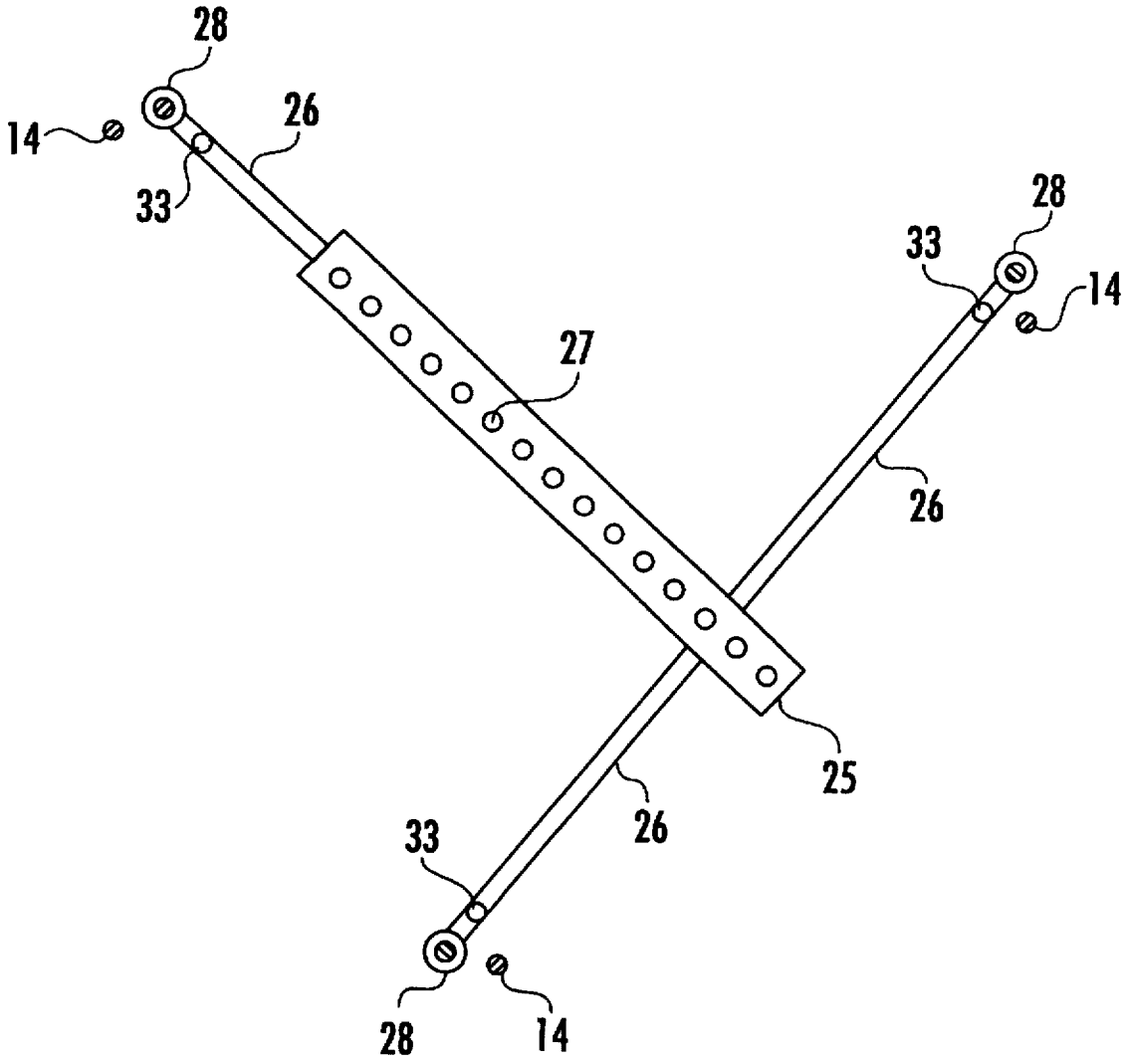
FIG. 3 is a top view of an organizer of the top of the risers.

Referring to FIG. 3, a top view of one embodiment of the organizer of the top of the risers is shown. The organizer 25 separates the risers from each other and orients the risers and the export risers in a particular geometry between the tendons 14 of the TLP. The geometry of the organizer may assume any geometry known to those of skill including: straight line, curve, circle, square, triangle, etc. The organizer 25 is held between the tendons 14 by supports 26, which comprise either rigid members or flexible members such as cables or wire. Guide post 28 are attached to the ends of the supports so that the organizer 25 may be secured to the tendons 14. The guide posts 28 are equipped with sliding bearings so that the organizer 25 may easily be moved from one position to another along the tendons 14. The risers extend through the organizer 25 via holes 27. The holes 27 are riser guide pipes with bellmouths. The interior of the holes 27 are coated with a low friction coating to ensure that the risers will easily slide through the holes 27. The organizer 25 is placed in a particular location relative to the TLP and the sea floor by wires or cables 33 which are attached to each of the supports 26.

Figure 4:
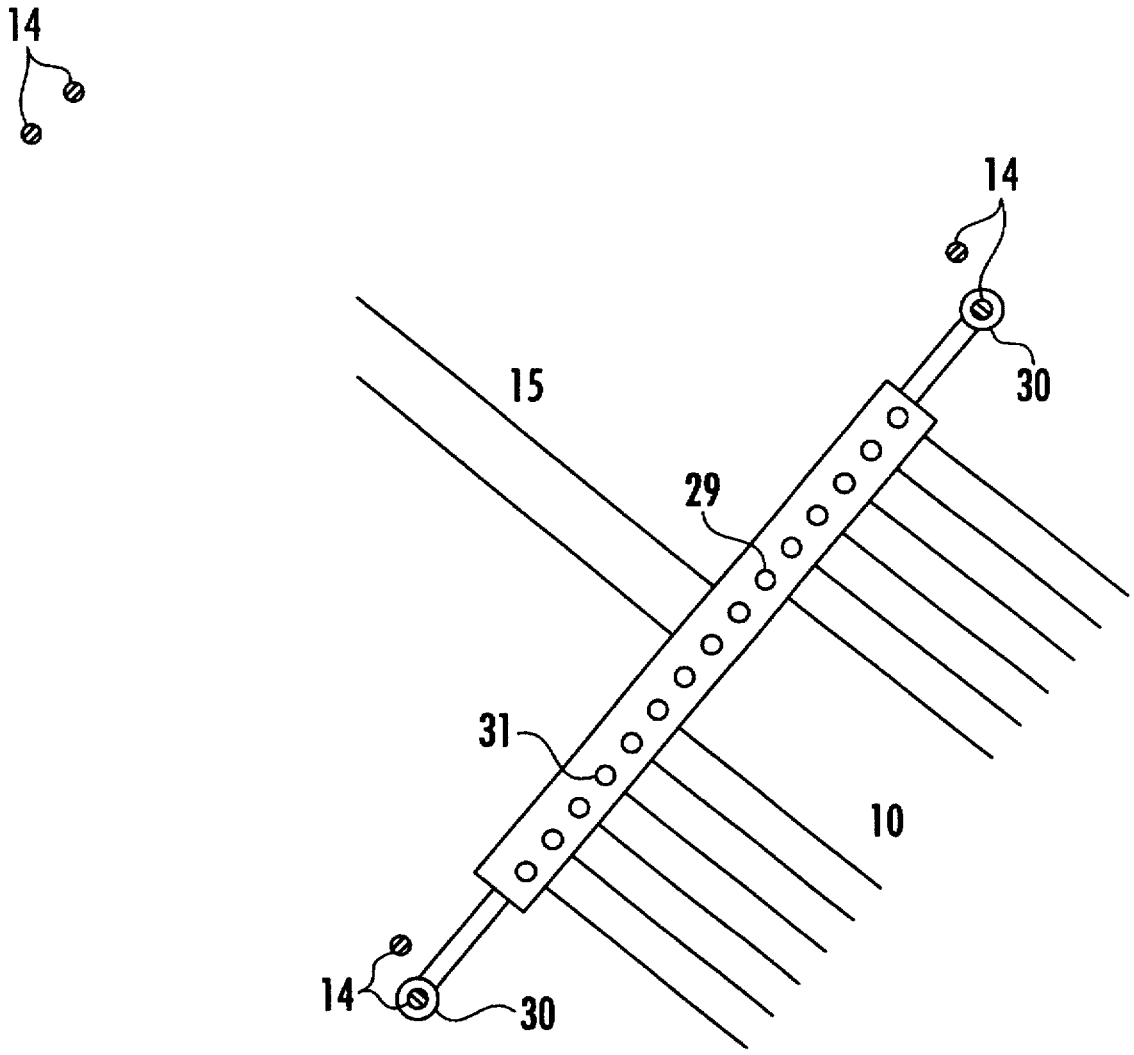
FIG. 4 is a view of an organizer of the bottom of the risers.

Referring to FIG. 4, a top view of one embodiment of the organizer of the bottom of the risers is shown. An organizer 29 separates the risers from each other and orients the risers 10 and the export risers 15 in a particular geometry between the tendons 14 of the TLP. Like the organizer of the top of the risers, the geometry of the organizer 29 may assume any geometry known to those of skill including: straight line, curve, circle, square, triangle, etc. In this particular embodiment, the organizer 29 comprises as straight line. Further, the geometry of the bottom organizer 29 need not be in the same geometry as the organizer of the top of the risers. However, in some application, it may be advantageous to organize the geometries to accommodate the particular application. Unlike the organizer of the top of the risers, the organizer 29 is attached directly to only two of the tendons 14. Guide posts 30 are attached to the ends of the organizer 29 for securing the organizer 29 to the tendons 14. The guide posts 30 are equipped with sliding bearings so that the organizer 29 may easily be moved from one position to another along the tendons 14. The risers extend through the organizer 29 via holes 31. The holes 31 are riser guide pipes with bellmouths. The interior of the holes 31 are coated with a low friction coating to ensure that the risers will easily slide through the holes 31. The risers 10 are shown extending out one side of the organizer 29, while the export riser 15 are shown extending out the other side.

Referring to FIGS. 3 and 4, the organizer 25 of the top of the risers and the organizer 29 of the bottom of the risers are shown from the same reference. Thus, the geometries of the two organizers are rotated relative to one another. In this particular embodiment, the position of organizer 25 is rotated about 90 degrees from the position of organizer 29. The two organizers are rotated relative to each other to induce tension in the risers 10 and export risers 15 so that they do not become entangled.

Figure 5:
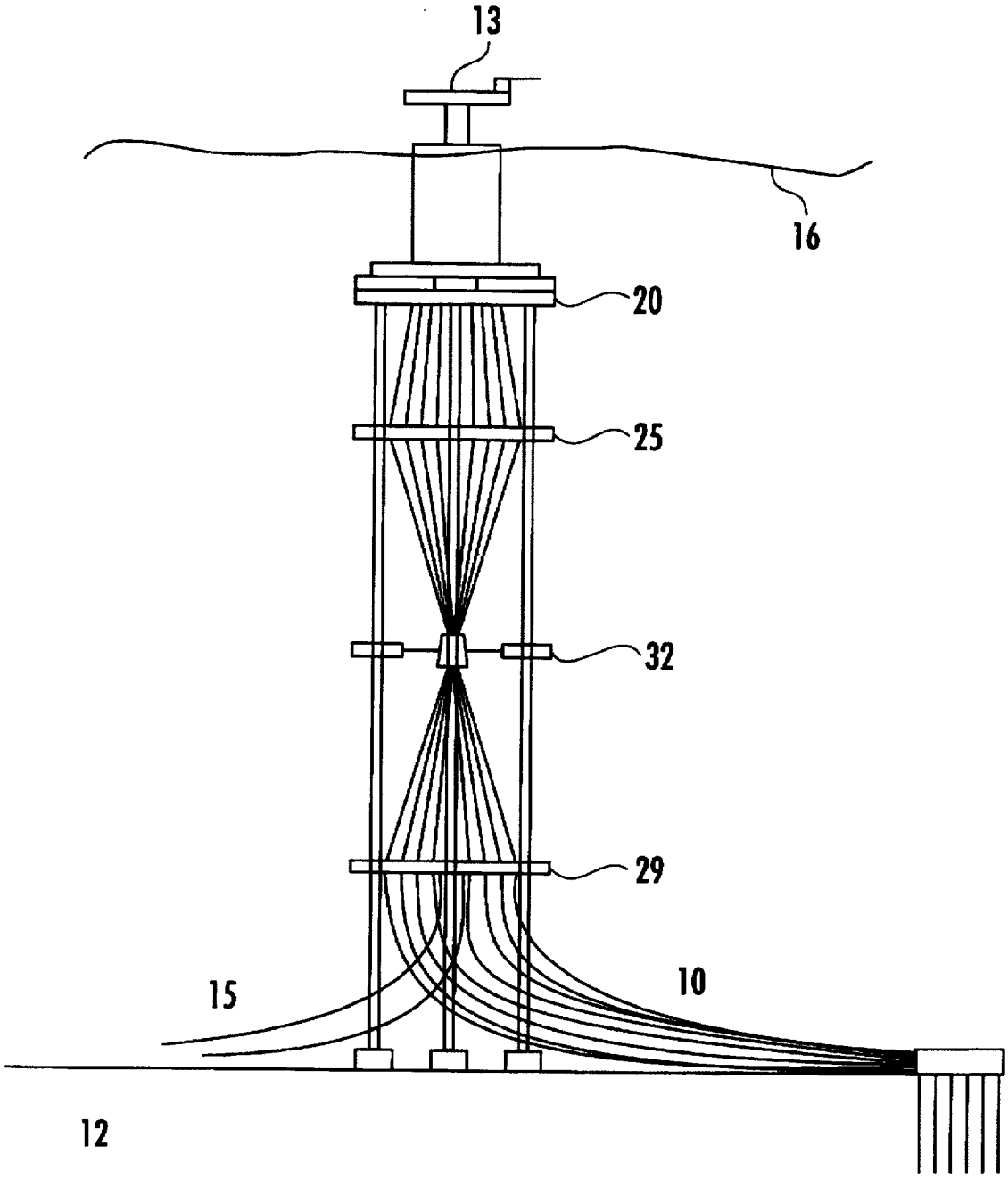
FIG. 5 is a plan view of one embodiment of an entire riser assembly with organizers at the top, middle and bottom.

Referring to FIG. 5, a plan view of one embodiment of the riser system is shown. Organizer 25 is located at the top of the risers 10 and organizer 29 is located at the bottom of the risers 10. In addition, an organizer 32 is located between organizer 25 and organizer 29. The position of organizer 32 is rotated 90 degrees relative to the position of organizers 25 and 29. In an alternative embodiment, organizer 32 is rotated 90 degrees from the position of organizer 25 and organizer 29 is rotated 180 degrees from the position of organizer 25. Depending upon the depth of the sea and the number of risers 10 extending to the production vessel 13, additional organizers may be necessary to provide additional support and tension. These additional organizers may or may not be rotated relative to each other depending upon the constraints of the particular application.

It is to be noted that the above described embodiments illustrate only typical embodiments of the invention and are therefore not to be considered a limitation of the scope of the invention which includes other equally effective embodiments.

I claim:

1. A process for stabilizing catenary flexible risers used in connection with a production platform used in connection with a well, the risers having a top and a bottom, the process comprising:

organizing the top of the risers in a first template;

organizing the bottom of the risers in a second template;

aligning the templates causing a twisting of the risers to impose tension in the risers; and connecting the top of the risers to a production manifold on the production platform.

2. A process as in claim 1, further comprising adjusting the height of said first template relative to the surface of the sea.

3. A process as in claim 1, further comprising adjusting the height of said second template relative to the surface of the sea.

4. A process as in claim 1:

wherein said first template has a first template opening pattern, wherein said second template has a second template opening pattern, and wherein said first opening pattern and said second opening pattern are the same.

5. A process as in claim 4, further comprising:

organizing the top of the risers above the first template with a third template, the third template having a third template pattern matching the production manifold.

6. A process as in claim 1:

wherein said first template has a first template opening pattern, wherein said second template has a second template opening pattern, and wherein said first opening pattern and said second opening pattern are different.

7. A process as in claim 6 further comprising:

organizing the top of the risers above the first template with a third template, the third template having a third template pattern matching the production manifold.

8. A flexible riser system for use with a marine production platform for use with at least one producing well, the system comprising:

a set of catenary flexible risers connected to the at least one producing well;

a first template, movably positioned beneath the production platform and including a set of first template openings through which said set of catenary flexible risers pass;

a second template, movably positioned beneath the production platform and including a set of second template openings through which said set of catenary flexible risers pass;

wherein at least one of the openings of the set of first template openings, through which at least one of the set of catenary flexible risers passes, has associated therewith a first opening axis;

wherein at least one of the openings of the set of second template openings, through which the at least one of the set of catenary flexible risers passes, has associated therewith a second opening axis;

wherein the first opening axis is different from the second opening axis.

9. A system as in claim 8:

wherein said first template includes a first template pattern of openings;

wherein said second template includes a second pattern of openings; and wherein said first pattern of openings is the same as said second pattern of openings.

10. A system as in claim 9, wherein said first pattern of openings is rotated with respect to said second pattern of openings.

11. A system as in claim 10, wherein said first and said second pattern comprise a line.

12. A system as in claim 10, wherein said first and said second pattern comprise a curve.

13. A system as in claim 10, wherein said first and said second pattern comprise a square.

14. A system as in claim 10, wherein said first and said second pattern comprise a triangle.

15. A system as in claim 8, further comprising a third template, movably positioned beneath the production platform and including a set of third template openings through which said set of catenary flexible risers pass;

wherein the production vessel includes a production manifold for attachment of the risers at manifold openings;

wherein said third template is movably positioned between said first template and the production manifold.

16. A system as in claim 15:

wherein the production manifold openings are arranged in a manifold opening pattern;

wherein said third template openings are arranged in a third template pattern;

wherein said third template pattern and the manifold opening pattern are the same.

17. A system as in claim 16, wherein said third template pattern and said first template pattern are different.

18. A system as in claim 16, wherein said third template pattern and said first template pattern are the same.

19. A system as in claim 8, wherein the production vessel includes tension legs and said first and second templates are slideably attached to the tension legs.

20. A system as in claim 19, wherein said first and said second templates are vertically adjustably mounted to the tension legs.

21. A system as in claim 20, wherein said first and second templates are suspended from the production vessel by cables.

22. A system as in claim 8, further comprising a third template, movably positioned beneath the production platform and including a set of third template openings through which said set of catenary flexible risers pass;

wherein the production vessel includes a production manifold for attachment of the risers at manifold openings;

wherein said third template is movably positioned between said first template and the production manifold.

23. A system as in claim 22, wherein said first and said second templates are vertically adjustably mounted to the tension legs.

24. A system as in claim 23, wherein said first and second templates are suspended on the production vessel by cables.

25. A system as in claims 22:

wherein the production manifold openings are arranged in a manifold opening pattern;

wherein said third template openings are arranged in a third template pattern;

wherein said third template pattern and the manifold opening pattern are the same.

26. A system as in claim 25, wherein said third template pattern and said first template pattern are different.

27. A system as in claim 25, wherein said third template pattern and said first template pattern are the same.

28. A system as in claim 22, wherein the production vessel includes tension legs and said first and second templates are slideably attached to the tension legs.

29. A system as in claim 28, wherein said first and said second templates are vertically adjustably mounted to the tension legs.

30. A system as in claim 29, wherein said first and second templates are suspended from the production vessel by cables.

* * * * *